United States Patent [19]

Garay et al.

[11] 4,313,119

[45] Jan. 26, 1982

[54] DUAL MODE TRANSCEIVER ANTENNA

[75] Inventors: Oscar M. Garay, Hollywood; Kazimierz Siwiak, Sunrise, both of Fla.

[73] Assignee: Motorola, Inc., Schaumburg, Ill.

[21] Appl. No.: 141,538

[22] Filed: Apr. 18, 1980

[51] Int. Cl.[3] ..... H01Q 1/24

[52] U.S. Cl. ..... 343/702; 343/724; 343/806

[58] Field of Search ..... 343/702, 724, 806

[56] References Cited

U.S. PATENT DOCUMENTS 3,987,448 10/1976 Scheppman ..... 343/702

4,193,076 3/1980 Ito ..... 343/702

*Primary Examiner*—Eli Lieberman

*Attorney, Agent, or Firm*—Sang Ki Lee; Edward M. Roney; James W. Gillman

[57] ABSTRACT

A dual mode antenna for a miniature radio transceiver includes a low profile loop antenna structure while mounted on a body and a high efficiency dipole antenna while held in the hand.

6 Claims, 9 Drawing Figures

DUAL MODE TRANSCEIVER ANTENNA

BACKGROUND OF THE INVENTION

This invention relates to an improved dual mode antenna. With the advance in the microelectronic circuitry such as large-scale integrated circuits or LSI circuits, it has been possible to build a radio receiver of a very small dimension, even smaller than a regular cigarette package for use as a radio pager worn or clipped onto a person's pocket.

A popular commercial pager of such a size includes a receiving antenna formed of a conducting U-shaped member having substantially parallel elongated arms which form sides of the housing of the receiver. Normally, the radio is clipped on a pocket or worn on a belt of a person, and the U-shaped antenna acts as an inductive loop antenna to detect the H field of the electromagnetic wave caused by the transmitted signal. For a more detailed description of such an antenna, one may refer to the U.S. Pat. No. 3,736,591 to Larry W. Rennels and William J. Wilson, and assigned to Motorola, Inc., the assignee of the present application. The U-shaped antenna is compact and has been found rather efficient as a loop antenna.

It has been found, however, that when the loop antenna is held away from a body it becomes inefficient. If the pager is only a one-way pager, that is, a radio receiver only, then the loop antenna is satisfactory in that the reception of the signal normally takes place as the person wears the radio on his bent or clipped onto his pocket.

However, there are needs for two-way miniaturized radios, such as talk-back pagers, designed to receive and transmit radio signals. The aforementioned loop antenna is satisfactory when the radio is worn on the person as mentioned before. But it has been found that when the radio is held away from the body of the person using it, the loop antenna becomes inefficient.

Dipole antenna of the collapsible type is known. Such a dipole antenna is described in the U.S. Pat. No. 4,121,218 to James Stuart Irwin and Francis Robert Steel, and assigned to Motorola, Inc., the assignee of the present invention. While the dipole antenna is highly satisfactory for use with portable radio, it is not adapted for use with a two-way miniature radio or talk-back pager of the type worn on the body of person.

SUMMARY OF THE INVENTION

It is a general object of the present invention to provide an efficient dual mode transceiver antenna for a miniature transceiver radio which may be worn on a person.

It is another object of the present invention to provide an antenna which overcomes the shortcomings and problems of the aforementioned prior art antenna.

In accordance with the present invention, the aforementioned objects are achieved by providing a dual mode transceiver antenna which includes a U-shaped conducting antenna and whip or a dipole antenna. The U-shaped antenna is adapted to fit over a casing of the radio transceiver and the whip or dipole antenna is mounted onto the radio casing in such a way that when the dipole antenna is folded over or collapsed the U-shaped antenna provides a closed loop to the radio. When the dipole antenna is flipped or swung open or extended, then the U-shaped loop mode antenna is decoupled and the dipole antenna is coupled to the radio.

In this manner, the miniaturized transceiver carried on a person in his pocket or on his belt with the dipole in the collapsed or folded position, the U-shaped antenna provides an efficient loop mode antenna. When the miniature radio is moved away from the body of the person and hand held, then the dipole antenna is opened, and in this manner, the loop antenna is de-coupled and the dipole antenna is coupled to the radio to provide an efficient dipole antenna function.

According to a feature of the present invention, the dipole antenna is made of a meander line dipole element disposed on a nonconductive planar member, wherein the meander line dipole element forms an equivalent helical antenna.

It is another feature of the present invention that the dipole antenna is a collapsible whip antenna.

The foregoing and other features of the present invention will be made clearer from the following detailed description of the illustrative embodiments of the invention in conjunction with the accompanying drawings.

DETAILED DESCRIPTION OF THE PREFERRED EMBODIMENT

Figure 1:
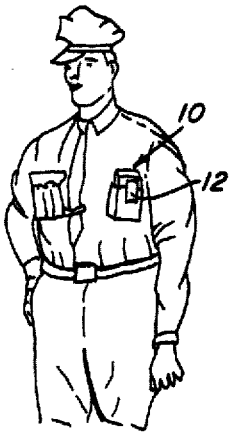
FIG. 1 is an illustrative miniature radio transceiver having an antenna in accordance with the present invention carried in the shirt pocket of a user.

In FIG. 1, there is shown a person carrying a miniature radio transceiver such as a talk-back pager 10 with an antenna carried in the shirt pocket of the user. The receiver has a clip 12 on the back side for holding the radio so that it will not fall out of the pocket if the person stoops over or moves suddenly.

Referring to FIGS. 2–5, there is shown a dual mode transceiver antenna in accordance with the present invention. As shown, the present antenna includes a U-shaped elongated planar conductive antenna made of two segments, 21 and 22, which is shaped to fit over the radio casing 20 which houses the miniaturized radio transceiver therein. The casing 20 is made of nonconductive material, and the two segments of the U-shaped antenna, 21 and 22, are dimensioned to fit over the casing and provide not only the conductive antenna function but also become part of the housing for the transceiver disposed in the casing 20.

Figure 2:
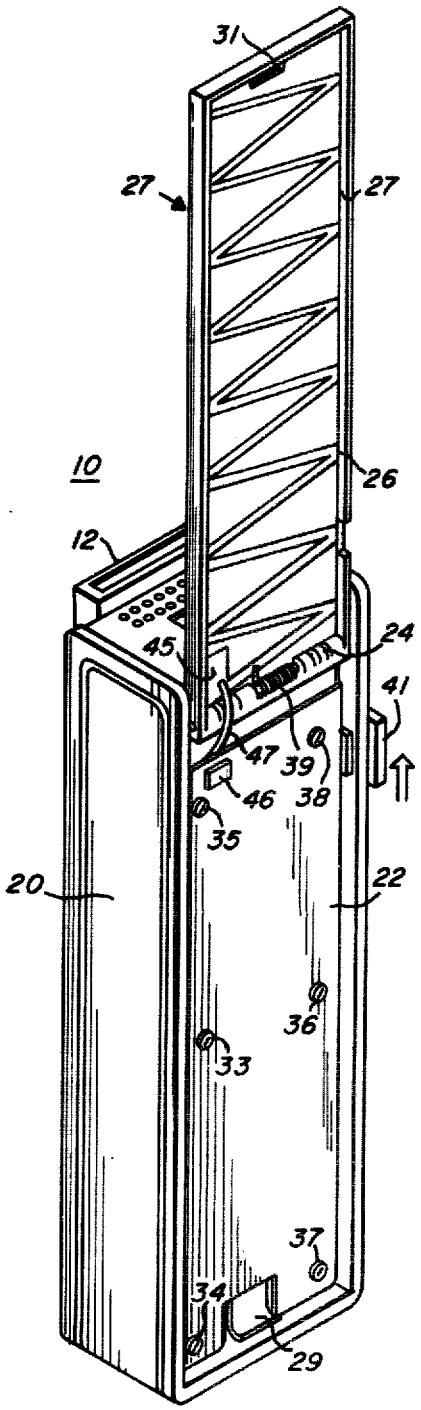
FIG. 2 shows a perspective view of a radio transceiver assembly with the dual mode antenna of the present invention on a transceiver, using a meander line antenna.
Figure 3:
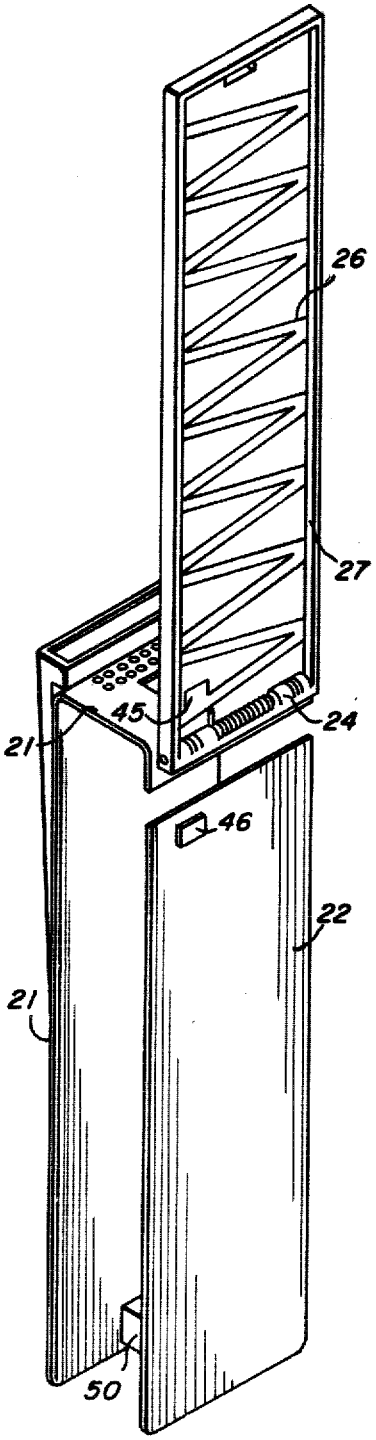
FIG. 3 shows a perspective view of the dual mode antenna of the present invention.
Figure 4:
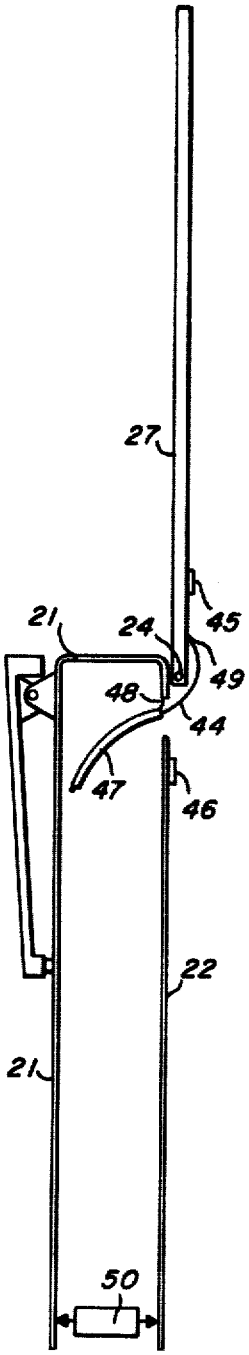
FIG. 4 shows the dual mode antenna of the present invention functioning as a dipole antenna with the dipole antenna in the unfolded position.

The antenna includes a dipole antenna element coupled to segment 21 of the U-shaped antenna by a hinge 24. The dipole antenna, as illustrated, includes a conductive meander line dipole element 26 disposed on a planar nonconductive member 27. The hinge 24 is positioned at the top end opposite the open end of the U-shaped loop antenna. The loop antenna is in two segments, and the first segment to which the hinge is mounted is separated from the second segment 22 by a space so that, with the dipole antenna in the open or extended position about the hinge, there is an opening between the two segments. Hence, with the dipole element 26 in the open or extended position, a segment 22 of the U-shaped loop is electrically separated from the other segment 21 of the U-shaped loop antenna as illustrated in FIG. 4. The dipole antenna includes the planar member 27 with the conductive meander line 26 disposed thereon. The planar member 27 is substantially coextensive with the other member 21 of the loop antenna, as illustrated in FIGS. 2, 3 and 4.

When the dipole antenna is closed or folded over about the hinge, the planar member 27 of the dipole antenna is of such a dimension that substantially coextends with the other segment 22 of the U-shaped loop antenna. The other member 22 of the U-shaped antenna is provided with a latch 29, and the planar member 27 of the dipole antenna has an aperture 31 positioned in such a way that when the planar member is folded over, the latch 29 catches the planar member 27 through the aperture 31. The other member 22 is fixedly secured or mounted onto the casing 20 by means of suitable fastening elements such as rivets 33 through 38. There is provided a release button or mechanism 41 which is affixed to the member 22 of the U-shaped loop antenna such that when it is desired to open or unfold the dipole antenna, one may apply a force against the button 41 upwardly to release a latch 29 and thereby swing the dipole antenna away from the member 22. A spring 39 is used to spring bias the antenna member 27 so that when released from the latch 29, the dipole member 27 flips open to the upright position as shown in FIGS. 2, 3 and 4. When one wishes to fold up the dipole antenna, then the planar member 27 is folded about the hinge 24 all the way down so that the planar member rests on the second member 22 of the U-shaped antenna. In this manner, the dipole member 27 is folded downward so that the latch 29 will catch the dipole 27 through the aperture 31 in the closed position and hold it in that position.

FIG. 4 shows a side view of the antenna in the dipole mode with the dipole in the open or unfolded position in the upright manner. As illustrated in FIG. 4, the center conductor 44 of the coaxial line 47 which comes from the miniaturized radio transceiver connects the radio circuit to the meander line dipole element 26 at the attachment 49 provided therefor. The shielded outer conductor of the coaxial line 47 connects to the conductive metal back and top of the first member of the U-shaped loop antenna at the attachment point 48.

As illustrated in FIG. 4, there are two contacts 45 and 46, one mounted on the second member 22 of the U-shaped antenna and the second contact 45 positioned on the dipole antenna 26. With the dipole member 26 in the extended or open or unfolded position, the first member 21 of the U-shaped antenna and the meander line dipole element 26 are fed by the coaxial line 47 at points 48 and 49, respectively. In this manner, a dipole is formed by one of the segments 21 of the closed loop antenna and the meander line dipole element 26 fed by the coaxial line at the points 48 and 49.

Figure 5:
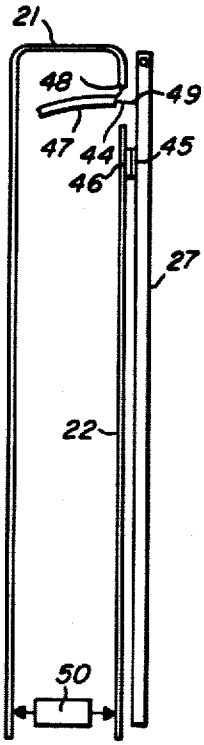
FIG. 5 shows the dual mode antenna of the present invention providing a loop mode operation with the dipole antenna in the folded position.

FIG. 5 illustrates the dual mode antenna set to provide a loop mode operation. If the dipole antenna member is closed or folded over, the contacts 45 and 46 come in contact and provide an electrical short. In this manner, the center conductor 44 of the coaxial line 47 is connected to the meander conductor of the dipole antenna and through the contacts 45 and 46 to the second member 22 of the loop antenna.

There is provided a suitable impedance matching network 50 of a conventional design coupled to the open end of the U-shaped antenna in a conventional manner. The impedance matching network and the manner in which it is coupled to the U-shaped antenna at the open end is generally known and is therefore not described here. One may refer to an example of such an impedance matching network and the way it is coupled as illustrated in the aforementioned U.S. Pat. No. 3,736,591.

The matching network 50 electrically connects the first member 21 of the U-shaped antenna to the second member 22 of the U-shaped antenna. The outer conductor of the coaxial line is connected to the first member 21 at the attachment point 48, and the center conductor of the coaxial line 47 is connected at the point 49 of the dipole antenna 26, and thence to a second member 22 of the dipole antenna via the contacts 45 and 46. In this manner, a loop antenna mode of the U-shaped antenna of members 21 and 22 is formed and fed by the coaxial line 47.

Hereinabove, an embodiment of a dual mode antenna has been described in accordance with the present invention, the basic principal of providing a dual mode of antenna operation using a dipole with a meander line dipole element disposed therein.

Various other modifications and changes may be made to the present dual mode antenna without departing from the spirit and scope of the present invention as taught in connection with the detailed description of an illustrative embodiment with reference to FIGS. 1 through 5 hereinabove. For example, as illustrated in FIGS. 6, 7, 8 and 9, instead of using a dipole with a meander line element disposed on a planar member to resemble a helical and dipole antenna, a collapsible whip-type antenna can be used as a part of the dual mode antenna.

Figure 6:
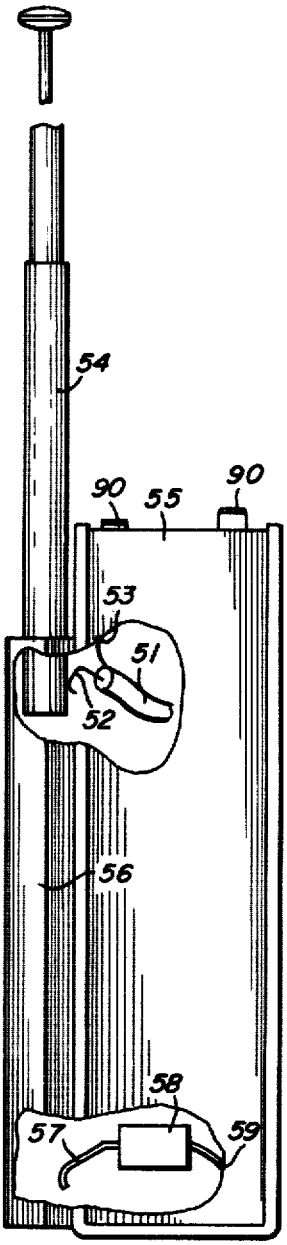

FIG. 6 shows a front view of the antenna in a dipole mode operation. The coaxial feed line 51 center conductor attaches to a connector 52 made of a springy and resilient contact on which the collapsible whip antenna element 54 slides along and forms electrical contact. The shielded outer conductor 53 of the coaxial line connects to the radio metal housing 55. Contact 57 is shown open and a matching network 58 performs no function in this dipole mode. Elements 54 and 55 form two poles of a dipole fed by 51 at 52 and 53.

Figure 7:
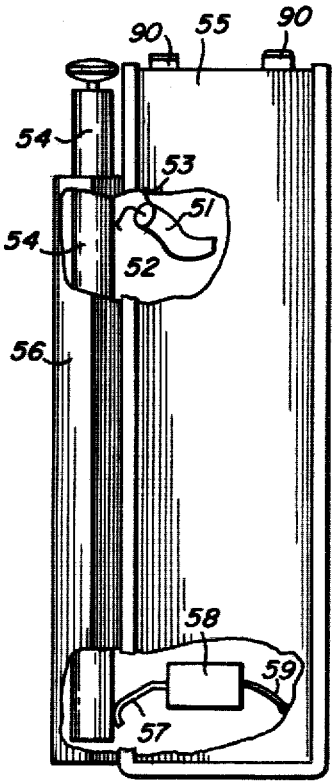

FIG. 7 shows a front view of the antenna in a loop mode operation. The coaxial line center conductor is attached to the collapsible whip element 54 through a sliding connector 52. The bottom portion of the whip antenna, when collapsed, contacts the loop matching network 58 through a sliding connector 57 of the springy and resilient type. The other side of the matching network connects to the bottom of the metal radio housing at 59. A complete loop is realized through 52, 54, 57, 58, 59 and 55. The contact at 57 is formed by retracting the whip element 54 and provides a switching function between dipole and loop modes.

Figure 9:
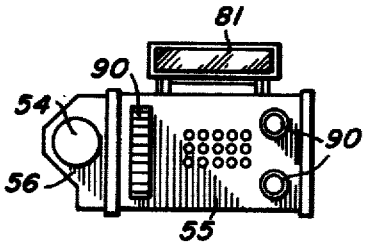
FIGS. 6–9 show top and side views of another illustrative embodiment of the dual mode antenna according to the present invention that uses a collapsible whip antenna.
Figure 8:
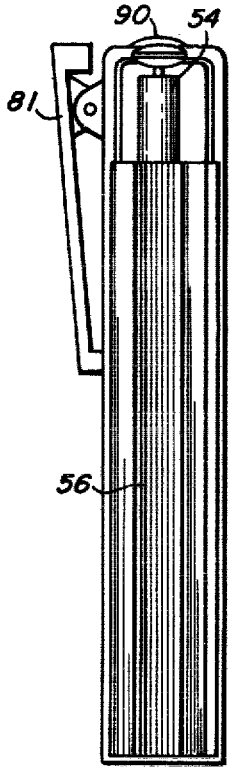

The whip element is supported by a plastic housing 56, which isolates the whip from the metal radio housing 55. FIGS. 8 and 9, respectively, show the side and top view indicating the locations of the belt clip 81 and radio controls 90.

The dual mode transceiver antenna as described hereinabove provides a number of significant advantages. Briefly stated, the present dual mode antenna provides, for the talk-back two-way radio pager, a closed loop antenna and a high efficiency dipole antenna with means for coupling one type of antenna and de-coupling the other type and vice versa. When the dipole is opened or extended, the dual mode antenna provides the high efficiency dipole operation, especially desirable in the outward transmission of the signal in the transmit mode. In accordance with the present invention, the dual mode antenna also provides a common feed point for both dipole and closed loop operating modes. In accordnce with the present invention in a very simple manner, a collapsible whip-type dipole antenna or a meander line dipole element simulating a helical dipole is used to provide a dipole mode of operation when they are in an extended position or unfolded position; and when they are in a folded or collapsed and withdrawn position, then the loop antenna is formed and the antenna is enabled to provide a loop mode of operation.

Various modifications and changes may be made to the present dual mode antenna without departing from the spirit and scope of the present invention.

We claim:

1. A dual mode antenna for a miniature radio transceiver comprising:

a U-shaped conductive antenna adapted to fit over a casing of the radio transceiver, wherein the U-shaped antenna is made of two separate segments spaced apart but disposed on the casing so that when the two are connected electrically they form the U-shaped antenna;

an impedance matching circuit coupled across the open end of the U-shaped antenna;

a dipole antenna element;

means for coupling the dipole antenna element in an extended position to de-couple one segment of the U-shaped antenna and couple the dipole antenna element and the other segment of the U-shaped antenna to the radio transceiver to provide a dipole antenna for the transceiver and coupling the dipole in a coupled position over the transceiver to complete electrical path between the two segments of the U-shaped antenna to form the U-shaped antenna to the transceiver and de-couple the dipole antenna from the transceiver to provide a loop antenna to the transceiver.

2. The antenna according to claim 1, wherein the radio is made of an elongated rectangular shape, the dipole antenna is made of an elongated planar nonconductive member of a size substantially the same as a side of the radio receiver and includes a conductive meander line dipole element disposed on the nonconductive member, said meander line dipole element forming an equivalent helical antenna and coupled to the feed point of a coaxial line from the radio.

3. The antenna according to claim 2, including an electrical contact disposed on the dipole element and on one segment of the U-shaped antenna, respectively, so that when the dipole antenna is folded over to rest on the segment, the two contacts come in contact and provide a closed loop electrical path between the two segments of the U-shaped antenna.

4. The antenna according to claim 3, including an actuable release mechanism adapted to retain the dipole antenna element in the folded position over the side of the radio resting on the one segment of the U-shaped antenna or release the dipole antenna to the extended position.

5. The antenna according to claim 1, the dipole antenna is a collapsible whip antenna.

6. An antenna system for a miniature radio transceiver comprising:

a conductive U-shaped antenna adapted to fit over a nonconductive casing of the miniature radio, wherein said U-shaped antenna is made up of two segments, first segment substantially forming one leg of the U-shape, and the second segment substantially L-shaped to complete the rest of the U-shape, but electrically separated from each other;

an impedance matching circuit coupleable across the open end of the U-shaped member;

a dipole antenna element;

a hinge disposed on the radio and adapted to couple an end of the dipole antenna element to an end of the L-shaped segment of the U-shaped antenna;

a coaxial line from the radio transceiver coupled to the L-shaped segment and the dipole element adjacent the hinge; and a conductive contact disposed on the dipole element and on the first segment adjacent the hinge, respectively, and disposed so that when the dipole element is folded over to rest on the first segment, the two contacts come in contact and a loop antenna made of the two segments and impedance matching circuit is formed for the radio transceiver and, when the dipole element is swung open about the hinge into an open position, the dipole element and one of the two segments form the dipole antenna for the radio transceiver.

* * * * *